US006394868B1

(12) United States Patent
Katz

(10) Patent No.: US 6,394,868 B1
(45) Date of Patent: May 28, 2002

(54) FLOATATION DEVICE FOR A CHILD

(76) Inventor: Robert Katz, 3570 Ridgewood, Apt. 305, Montréal, Québec (CA), H3V 1C2

( * ) Notice: Subject to any disclaimer, the term of this patent is extended or adjusted under 35 U.S.C. 154(b) by 0 days.

(21) Appl. No.: 09/655,486

(22) Filed: Sep. 5, 2000

(51) Int. Cl.[7] ..... B63B 35/74
(52) U.S. Cl. ..... 441/130; 441/135
(58) Field of Search ..... 441/129, 130, 441/131, 132, 135, 38; 114/361, 66; 472/128, 129; 135/88.01

(56) References Cited

U.S. PATENT DOCUMENTS 1,748,170 A * 2/1930 Chesnut
2,618,285 A * 11/1952 Heisig
3,042,945 A * 7/1962 Saeman
4,799,910 A * 1/1989 Kellough
5,685,753 A * 11/1997 Canela et al. ..... 441/129
5,766,052 A 6/1998 Metro

* cited by examiner

*Primary Examiner*—Sherman Basinger

(57) ABSTRACT

A floatation device for a child having a buoyant board, with generally parallel top and bottom surfaces, and with a child opening in about the middle of the board. A child seat is provided beneath the opening attached to the board for supporting a child in the opening with his abdomen about even with the board. A wet play area is recessed in the top surface of the board in front of the opening in reach of the child, the play area having a bottom surface below the waterline of the board when a child is on the board. An opening in the board connects the play area to the bottom surface to allow water to enter the play area when the board is in the water. A canopy is mounted on the board. The canopy has an awning support mounted on the board behind the child opening. An awning is rotatably mounted on the awning support for movement between an operative position where the awning is generally horizontal over the child opening and an inoperative position allowing access to the child opening.

18 Claims, 3 Drawing Sheets

FLOATATION DEVICE FOR A CHILD

BACKGROUND OF THE INVENTION

1. Field of the Invention

This invention is directed toward a child's floatation device.

2. Description of the Related Art Including Information Disclosed Under CFR §§1.97–1.99

Floatation devices for a child are known as shown in U.S. Pat. No. 5,766,052. However, the known devices do not permit the child to interact readily with the water he is floating on nor do they provide a readily adjustable and easily removably canopy. The known devices also do not have an adjustable and easily removable seat for the child.

SUMMARY OF THE INVENTION

It is the purpose of the present invention to provide a child's floatation device having means whereby the child in the device can readily interact with the water he is floating on. It is another purpose of the present invention to provide a child's floatation device having a canopy that is readily removable and that also is easily movable between operative and inoperative positions. It is a further purpose of the present invention to provide a seat for the floatation device that is adjustable in height and that is also easily removable.

In accordance with the present invention a floatation device is provided with a depressed play area within easy reach of the child which play area can partly fill with water providing the child with a splash play area. The floatation device can also be provided with viewing means in the device in front of the child allowing the child to view into the water hl is floating on.

Also in accordance with the present invention, a floatation device is provided with a canopy that is easily connected or disconnected to the float. The canopy is also easily adjustable between a first, protective position where the canopy protects the child from the sun or rain and a second, open position allowing the child to be easily placed within or removed from the device. The canopy has an awning that can be pivoted on awning support means between first stop means locating it in the protective position and second stop means locating it in an open position.

The invention is particularly directed toward a flotation device for a child having a buoyant board, with generally parallel top and bottom surfaces, and with a child opening in about the middle of the board. A child seat is provided beneath the opening attached to the board for supporting a child in the opening with his abdomen about even with the board. A wet play area is recessed in the top surface of the board in front of the opening in reach of the child, the play area having a bottom surface below the waterline of the board when a child is on the board. An opening in the board connects the play area to the bottom surface to allow water to enter the play area when the board is in the water.

The invention is also particularly directed toward a floatation device for a child having a buoyant board with a child opening in about the middle of the board. A child seat is provided beneath the opening attached to the board for supporting a child in the opening with his abdomen about even with the board. A canopy is mounted on the board. The canopy has an awning support mounted on the board behind the child opening. An awning is rotatably mounted on the awning support for movement between an operative position where the awning is generally horizontal over the child opening and an inoperative position allowing access to the child opening.

DESCRIPTION OF THE PREFERRED EMBODIMENTS

Figure 1:
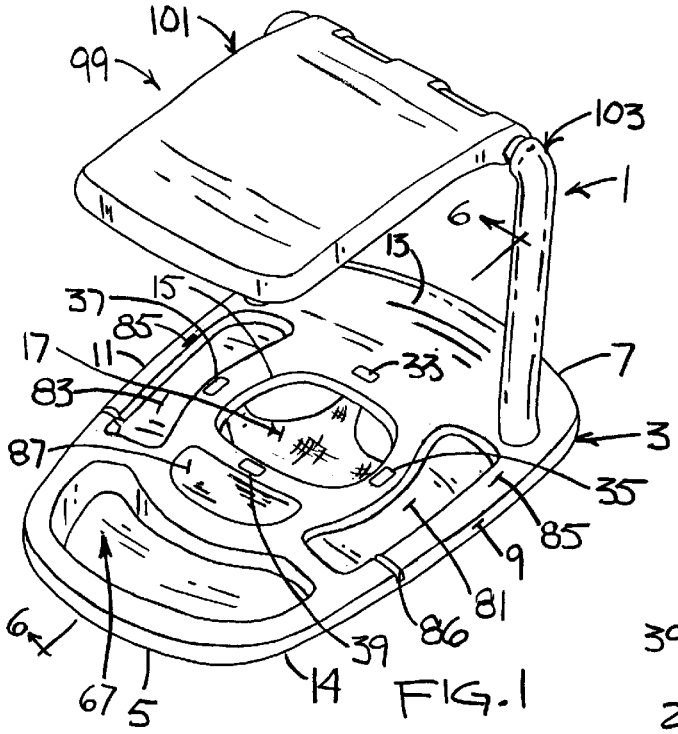
FIG. 1 is a perspective view with the awning in the inoperative position.

The floatation device 1 of the present invention, as shown in FIG. 1, has buoyant board 3. The board 3 is of general rectangular shape when viewed in plan. The front end 5 of the board can be rounded, when viewed in plan, as can the rear end 7. The front end 5 can be slightly shorter than the rear end 7. The front and rear ends 5, 7 are joined by slightly outwardly curved sides 9, 11. The board 3 has generally parallel top and bottom surfaces 13, 14 joined by the front and rear ends 5, 7 and the sides 9, 11. The front end is arbitrarily taken as that end which a child faces when in the device. The board is made from suitable, foamed, thermoplastic material and is preferably solid. The board can be formed with a rigid outer skin if desired and has a size and buoyancy to support a small child. By way of example, the board can be about two feet long; one and half feet wide; and about two inches thick. The board could also be formed by blow molding and in this case would be hollow.

Figure 2:
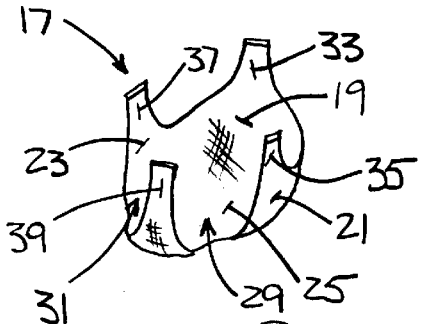
FIG. 2 is a perspective view of the seat used in the floatation device.
Figure 3:
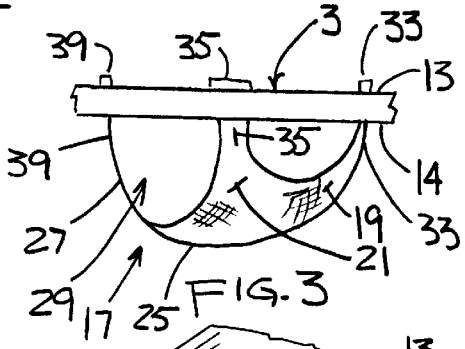
FIG. 3 is a partial cross-section view showing the seat installed on the board.

A child opening 15 is provided in about the middle of the board 3. The opening 15 is generally circular and large enough to comfortably receive a child therein with the top and bottom edges of the opening being rounded. A flexible child seat 17, as shown in FIGS. 2 and 3, is fastened to the board 3 about the opening 15 to supported a child in a seated position within the opening. When fastened to the board, the seat 17 is located below the board. The seat 17 has a back and side areas 19, 21, 23 extending up from a bottom area 25. A narrow front area 27 also extends up from the bottom area 25. Leg openings 29, 31 are formed between the narrow front area 27 and the side areas 21, 23. A connector strap 33, 35, 37, 39 extends up from each back, side and front area 19, 21, 23, 27 respectively of the seat. The straps 33 to 39 are sized to pass through four slots 41 in the board, the slots located generally equidistant about the child opening 15 with one slot at the front of the opening; one slot at the rear; and a slot at each side.

Figure 4:
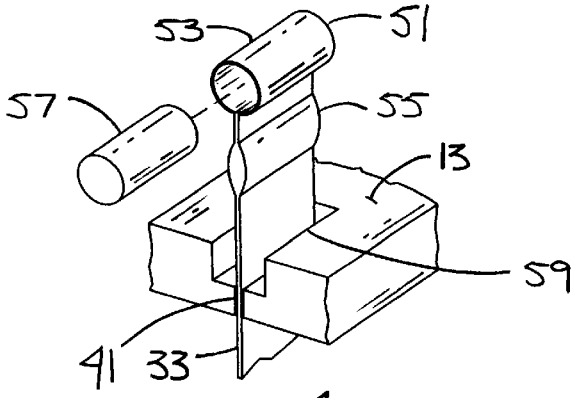
FIG. 4 is a detail view, in partial section, showing the seat straps passing through the board.
Figure 5:
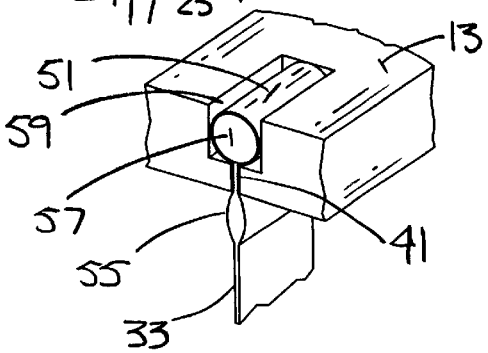
FIG. 5 is a detail view, in cross-section, showing the seat strap installed.

Each connector strap 33 to 39 is the same so only one will described in detail. Connector strap 33, as shown in FIG. 4, has a first sleeve 51 at its free end 53 and, preferably, a second sleeve 55 spaced a short distance from the first sleeve 51. A portion of the strap 33, via the strap end 53, and with the sleeves 51, 55 flattened, is passed through its associated slot 41 in the float board directly behind the opening 15. The strap end 53 is pushed up through the slot 41 until the first sleeve 51 is above the board. The sleeve 51 is then opened up and a cylindrical pin 57, larger than the slot 41, is inserted snugly into the sleeve 51, the pin 57 being transverse to the strap 33. The strap 33 is then pulled down to locate the pin 57 and sleeve 51 snug against the board to retain the pin within the sleeve. Preferably, a recess 59 is provided in the top surface 13 of the board surrounding each slot 41, as shown in FIG. 5.. The pin 57, in the sleeve 51, sits snug within the recess 59, and prevents the strap 33 from passing back out of the slot 41. Each strap 33 to 39 is mounted on the board in the same way. The weight of the child in the seat 17 maintains the straps 33 to 39 taut and the pins 57 in the recesses 59. The combination of the sleeves 51, 55 in the straps 33 to 39 and the pins 57 form connector means for connecting the seat to the board. The recesses 59 also from part of the connecting means. If the child is smaller and needs a shorter seat, the pins 57 are inserted into the second sleeve 55 of each strap. It will be seen that the seat 17 can be easily adjusted between sizes and also easily removed, if needed, for washing or replacement while the seat 17 has been shown with four straps, three or five straps could also be used with the same number of slots 41.

Figure 6:
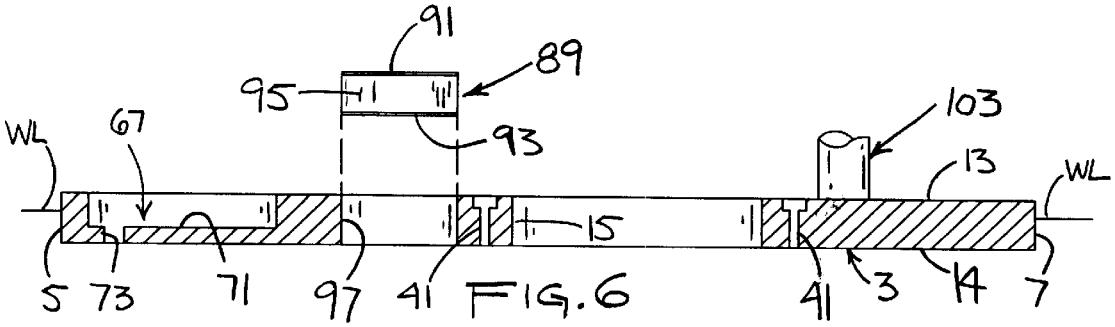
FIG. 6 is a cross-section view of the board taken along line 6—6 in FIG. 1.

The board 3, as shown in FIGS. 1 and 6, has a wet play area 67 between the child opening 15 and the front end 5, the play area 67 within reach of a child seated in the opening 15. The play area 67 is recessed below the top surface 13 of the board 3 with the bottom surface 71 of the area 67 located below the waterline WL of the board when it is in the water with a child on board. A water opening 73 extends through the board 3 connecting the bottom surface 71 of the play area 67 with the bottom surface 14 of the board. The opening 73 allows water to flow into the play area 67 to a height equal to the water line WL of the board. The water is held in the recessed area allowing the child to play in this area with the water.

The wet play area 67 could also be formed without the opening 73. In this case, the play area 67 is filled manually with water for the child to play in. The front wall of the board 3, defining the front of the play area, could be slotted from the top down to a depth at which it is desired to retain water in the play area. Any excess water would flow out of the play area through the slot.

The board 3 also has dry play areas 81, 83 on either side of the opening 15 and adjacent the sides 9, 11 of the board, as shown in FIG. 1. These dry play areas 81, 83 are also recessed in the top surface 13 of the board but are not connected to water. Recessing the play areas 81, 83 provides dry containment for toys in these areas. The outer walls 85, defining part of the play areas 81, 83, can be slotted as shown at 86 to water to drain out of the dry play areas. Alternatively, the walls separating the dry play areas 81, 83 from the wet play area 67 could be slotted to allow water to flow from the dry play areas to the wet play area.

The board 3 also preferably has a window 87 in the board between the child opening 15 and the wet play area 67 as shown in FIGS. 1 and 6. The window 87 preferably comprises a transparent box 89 having a thickness equal to the thickness of the board. The box 89 has transparent, parallel, top and bottom walls 91, 93 joined by a sidewall 95 which may, or may not, be transparent. The box 89 is snugly mounted within a window opening 97 in the board 3 and maintained therein with suitable fastening means, not shown. The box 89 is not normally meant to be removed from the board. The thickness of the box prevents air bubbles and/or turbulence from forming under the window which could make it difficult to see through the window. The window 87, positioned just in front of the opening 15, allows the child to easily see into the water.

Figure 7:
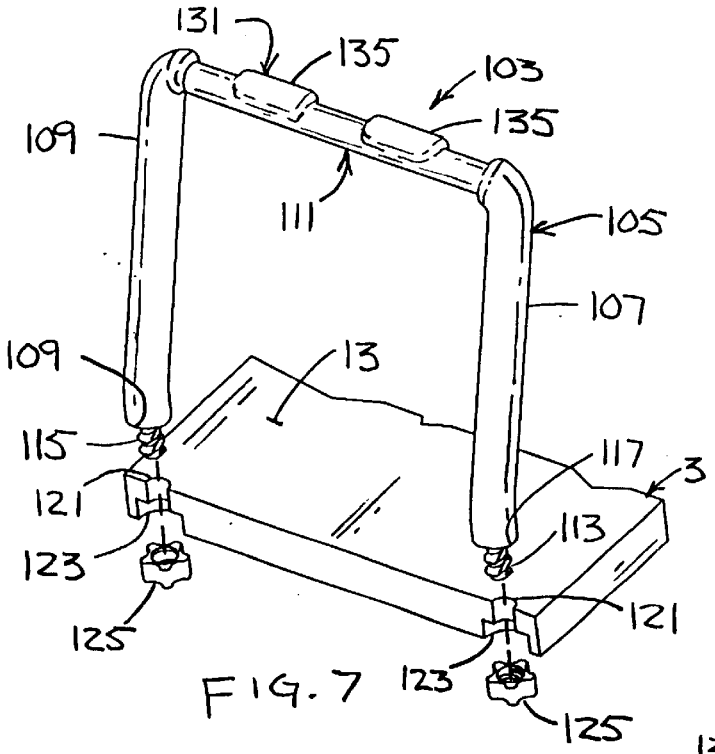
FIG. 7 is a perspective, exploded, view of the mounting member of the canopy.
Figure 8:
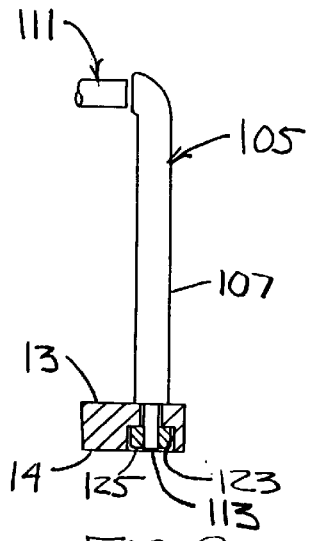
FIG. 8 is a detail cross-section view showing the mounting member installed.

A canopy 99 is provided for the board 3 as shown in FIG. 1. The canopy 99 includes an awning 101 which has a generally quadratic shape and is sized to provide protection and shade for a child in the opening 15. The awning 101 is mounted along one edge on an awning support 103 which in turn is mounted on the board 3. The awning support 103, as shown in FIGS. 7 and 8, preferably comprises a un-shaped member 105 having a pair of downwardly extending legs 107, 109 joined by a horizontal, cylindrical, cross-bar 111. The cross-bar 111 is non-rotatably mounted by suitable means, not shown, on the top ends of the legs 107, 109. A pair of pins 113, 115, with large threads thereon, project from the bottom ends 117, 119 of the legs 107, 109. The pins 113, 115 pass through a pair of holes 121 in the board 3 just behind, and to either side of, the opening 15, the ends 117, 119 of the legs 107, 109 abutting on the top surface 45 of the board. A recess 123 is provided in the bottom surface 14 of the board, surrounding each hole 121. The threaded pin 113, 115 on the end of each leg 107, 109 enters the recess 123 and a nut 125, in the recess 123, is threaded onto the pins 113, 115 to firmly mount the support 103 on the board 3. Other easily detachable mounting means for the support 103 may be used.

Figure 9:
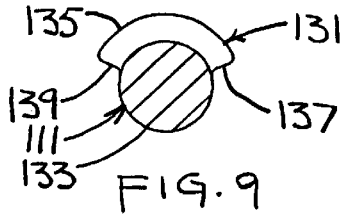
FIG. 9 is a cross-section view of the cross-bar of the mounting member.

The cross-bar 111 of the awning support 103 has stop means 131 on its outer cylindrical surface 133 as shown in FIGS. 7 and 9. The stop means 131 comprises a pair of curved abutments 135 projecting radially from the cross-bar 111. The abutments 135 extend on the bar along a line that is parallel to the axis of the cross-bar 111 and are curved about nearly one-half of the circumference of the cross-bar. The abutments 135 are located in the upper rear quadrant of the cross-bar 111 when seen in cross-section when the cross-bar:is mounted on the board. The abutments 135 provide first and second stop surfaces 137, 139.

Figure 10:
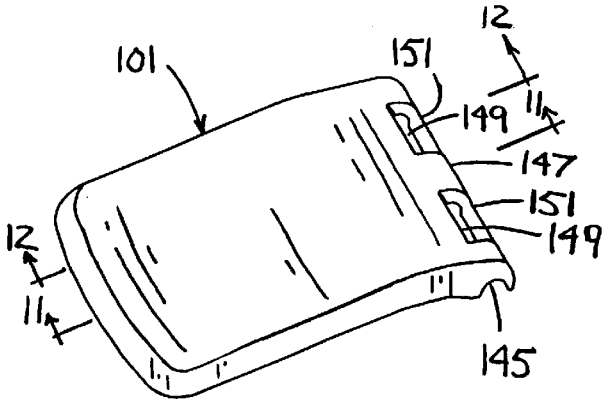
FIG. 10 is a perspective view of the awning.
Figure 12:
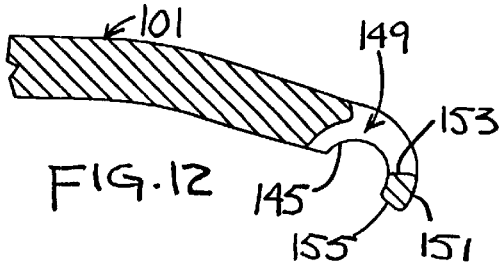
FIG. 12 is cross-section view of the awning taken along line 12—12 in FIG. 10
Figure 11:
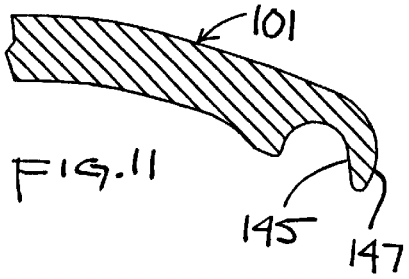
FIG. 11 a cross-section view of the awning taken along line 11—11 in FIG. 10.

The awning 101, as shown in FIGS. 10 to 12, has a downwardly facing groove 145 at its rear end 147 that is generally sized to receive the cross-bar 111. The awning also has two cutouts 149 intersecting the groove 145 to partly receive the abutments 135 on the cross-bar 111. The cutouts 149 create a pair of stop bars 151 at the rear end of the awning 101 with each stop bar 151 providing first and second stop surfaces 153, 155 as shown in FIG. 12.

Figure 13:
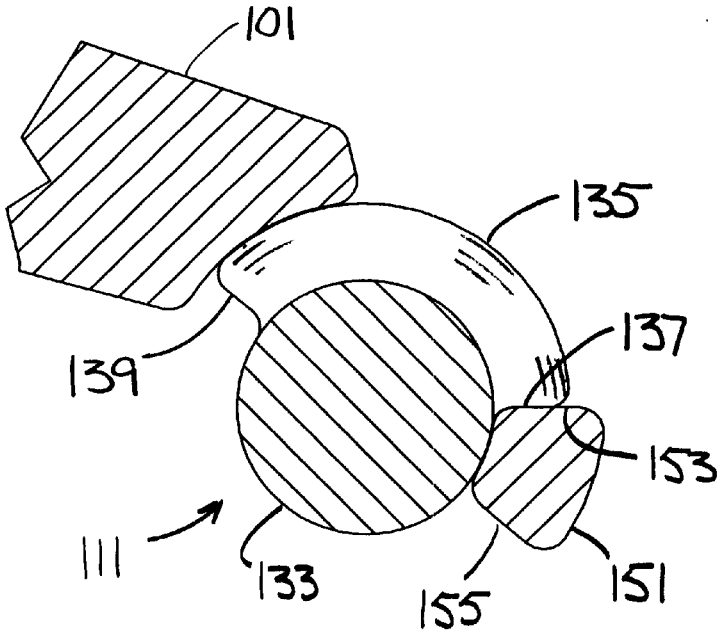
FIG. 13 is a detail, cross-section view showing the awning in the operative position on the cross-bar.

The awning 101 is mounted on the cross-bar 111 as the cross-bar 111 is being mounted between the support legs 107, 109. The cross bar 111 is placed in the groove 145 on the awning with the abutments 135 facing down. The cross bar 111 is then rotated to place first stop surface 137 on the abutment 135 against first stop surface 153 on stop bar 151. The cross bar 111 is then mounted in this position between the support legs 107, 109 with the abutment 135 facing up and slightly rearwardly as shown in FIG. 13. In this operative position the awning 101 is horizontal over the child opening 15 as shown in FIG. 1. The weight of the awning 101 causes the first stop surface 153 on its stop bar 151 to bear against the fixed first stop surface 137 on the abutment 135 on the fixed cross-bar 111 to hold the awning in position.

Figure 14:
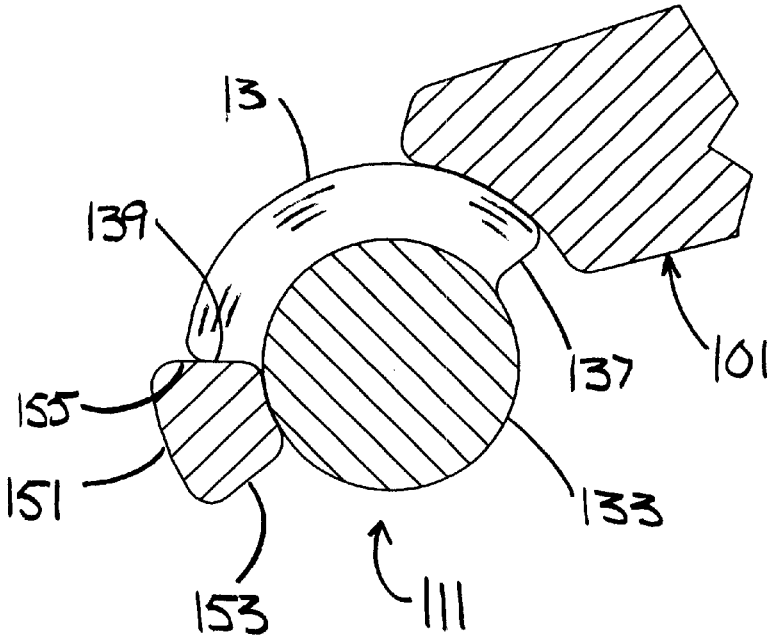
FIG. 14 is a detail, cross-section view showing the awning in an inoperative position on the cross-bar.

The awning 101 can be rotated on the cross-bar 111 from this operative position to an inoperative position where the awning is upside down over the rear of the board. In this inoperative position, the second stop surface 155 of the stop bar 151 on the awning 101 abuts against the second fixed stop surface 139 on the abutment 135, as shown in FIG. 14, to hold the awning 101 in this inoperative position.

I claim:

1. A flotation device for a child having a buoyant board with a child opening in about the middle of the board, the board having generally parallel top and bottom surfaces; a child seat beneath the opening attached to the board for supporting a child in the opening with his abdomen about even with the board; a wet play area recessed in the top surface of the board in front of the opening and in reach of the child, the play area having a bottom surface below the waterline of the board when a child is on the board; and an opening in the board connecting the play area to the bottom surface to allow water to enter the play area when the board is in the water.

2. A floatation device as claimed in claim 1 including a window opening in the board between the child opening and the wet play area, and a window mounted in the window opening.

3. A floatation device as claimed in claim 2 wherein the window has a thickness equal to the thickness of the board.

4. A floatation device as claimed in claim 2 including: a canopy, the canopy having an awning support mounted on the board behind the child opening, and an awning mounted along one edge on the awning support for movement between an operative position where the awning is generally horizontal over the child opening and an inoperative position allowing access to the child opening.

5. A floatation device as claimed in claim 4 wherein the awning support has a cross-bar extending between two legs, the free ends of the legs mounted on the board; the cross bar having at least one radial, axially extending abutment on its surface providing first and second stop surfaces; the awning having an opening at its one edge for the abutment and a stop bar adjacent the opening with first and second stop surfaces, the first stop surfaces on the abutment and stop bar cooperating to hold the awning in the operative position and, with the awning rotated on the cross-bar, the second stop surfaces on the abutment and stop bar cooperating to hold the awning in the inoperative position.

6. A floatation device as claimed in claim 5 wherein threaded pins extend from the ends of the legs of the awning support and pass through holes in the board into recesses; and nuts in the recesses threaded onto the pins to draw the ends of the legs tight against the board.

7. A floatation device as claimed in claim 1 including: a canopy, the canopy having an awning support mounted on the board behind the child opening, and an awning mounted along one edge on the awning support for movement between an operative position where the awning is generally horizontal over the child opening and an inoperative position allowing access to the child opening.

8. A floatation device as claimed in claim 7 wherein the awning support has a cross-bar extending between two legs, the free ends of the legs mounted on the board; the cross bar having at least one radial, axially extending abutment on its surface providing first and second stop surfaces; the awning having an opening at its one edge for the abutment and a stop bar adjacent the opening with first and second stop surfaces, the first stop surfaces on the abutment and stop bar cooperating to hold the awning in the operative position and, with the awning rotated on the cross-bar, the second stop surfaces on the abutment and stop bar cooperating to hold the awning in the inoperative position.

9. A floatation device as claimed in claim 8 wherein threaded pins extend from the ends of the legs of the awning support and pass through holes in the board into recesses; and nuts in the recesses threaded onto the pins to draw the ends of the legs tight against the board.

10. A floatation device for a child having a buoyant board with a child opening in about the middle of the board; a child seat beneath the opening attached to the board for supporting a child in the opening with his abdomen about even with the board; a canopy mounted on the board, the canopy having an awning support mounted on the board just behind the child opening, the canopy having an awning of generally quadratic shape, the awning mounted along one edge on the awning support to normally extend forwardly from the owning support generally horizontally to cover the child opening in an operative position, the awning mounted for movement, relative to the awning support, between the operative position and an inoperative position uncovering the child opening allowing access to the child opening.

11. A floatation device as claimed in claim 10 wherein the awning support has a cross-bar extending between two legs, the free ends of the legs mounted on the board; the cross bar having at least one radial, axially extending abutment on its surface providing first and second stop surfaces; the awning having an opening at its one edge for the abutment and a stop bar adjacent the opening with first and second stop surfaces, the first stop surfaces on the abutment and stop bar cooperating to hold the awning in the operative position and, with the awning rotated on the cross-bar, the second stop surfaces on the abutment and stop bar cooperating to hold the awning in the inoperative positions.

12. A floatation device as claimed in claim 11 wherein threaded pins extend from the ends of the legs of the awning support and pass through holes in the board into recesses; and nuts in the recesses threaded onto the pins to draw the ends of the legs tight against the board.

13. A floatation device as claimed in claim 11 including a window opening in the board between the child opening and a wet play area, and a window mounted in the window opening.

14. A floatation device as claimed in claim 13 wherein the window has a thickness equal to the thickness of the board.

15. A floatation device as claimed in claim 10 including a window opening in the board just in front of the child opening and a window mounted in the window opening.

16. A floatation device as claimed in claim 15 wherein the window has thickness equal to the thickness of the board.

17. A floatation device for a child having a buoyant, rigid, board with a child opening in about the middle of the board; a child seat beneath the opening attached to the board for supporting a child in the opening with his abdomen about even with the board; a viewing opening in the board just in front of the child opening; and a window mounted in the viewing opening allowing a child seated in the child opening to view the water through the window.

18. A floatation device as claimed in claim 17 wherein the window has a thickness equal to the thickness of the board.

* * * * *